US005945954A

United States Patent [19]

Johnson

[11] Patent Number: 5,945,954

[45] Date of Patent: Aug. 31, 1999

[54] ANTENNA ASSEMBLY FOR TELECOMMUNICATION DEVICES

[75] Inventor: Greg F. Johnson, Watsonville, Calif.

[73] Assignee: Rangestar International Corporation, Aptos, Calif.

[21] Appl. No.: 09/008,618

[22] Filed: Jan. 16, 1998

[51] Int. Cl.[6] ..... H01Q 1/26

[52] U.S. Cl. ..... 343/702; 343/700 MS; 343/770; 343/767

[58] Field of Search ..... 343/702, 700 MS, 343/767

[56] References Cited

U.S. PATENT DOCUMENTS

| | | | |
|---|---|---|---|
| 3,183,511 | 5/1965 | Ajioka | 343/771 |
| 3,810,183 | 5/1974 | Krutsinger et al. | 343/708 |
| 4,410,890 | 10/1983 | Davis et al. | 343/419 |
| 4,975,711 | 12/1990 | Lee | 343/702 |
| 5,170,173 | 12/1992 | Krenz et al. | 343/702 |
| 5,677,698 | 10/1997 | Snowdon | 343/770 |
| 5,828,343 | 3/1996 | MacDonald, Jr. et al. | 343/702 |
| 5,831,578 | 9/1996 | Lefvre | 343/700 MS |

*Primary Examiner*—Don Wong
*Assistant Examiner*—James Clinger
*Attorney, Agent, or Firm*—Larkin, Hoffman, Daly & Lindgren, Ltd.

[57] ABSTRACT

A planar, compact, multiple-element directive antenna for a hand-held radio frequency transceiver, such as a cellular telephone or PCS device, is provided which has an active radiating conductor element, a dielectric spacing member, and a conductive ground plane. The operative conductive round plane may be provided solely by an existing one internal with the hand-held transceiver, such as a printed wiring board, a metal chassis, or a metallized plastic surface, or by a parallel small ground plane coupled capacitively or directly to the larger transceiver ground plane. The multiple-element directive antenna allows increased range, improved voice/data quality, increased battery life, reduced user exposure to radio frequency radiation, elimination of user antenna adjustments, and reduction of antenna susceptibility to damage.

20 Claims, 4 Drawing Sheets

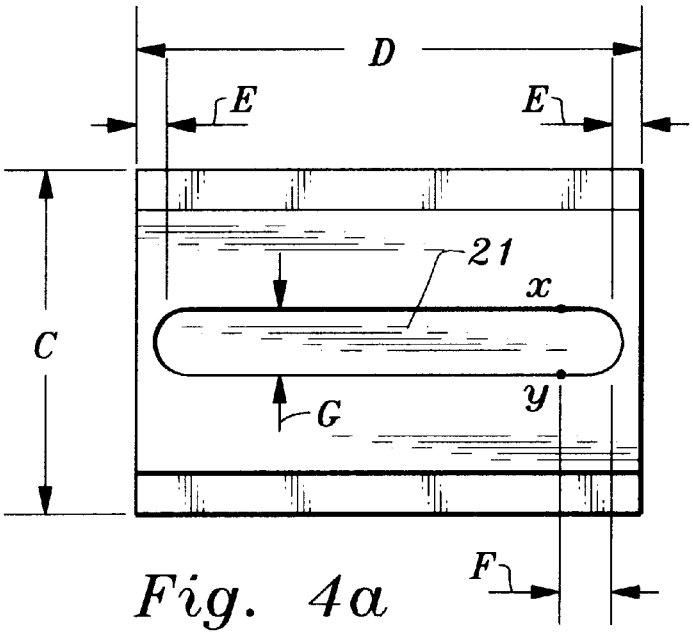
Fig. 4a
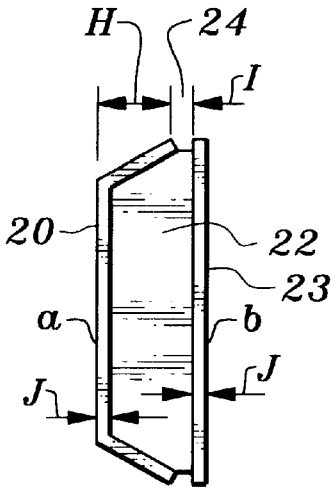
Fig. 4b
| DIMENSION | TYPICAL VALUE FOR 1850–1990 MHZ & $\varepsilon_r$ OF 22 (DIELECTRIC) = 1 |
|---|---|
| C | 1.25" |
| D | 1.70" |
| E | .05" |
| F | .20" |
| G | .20" |
| H | .24" |
| I | .01" |
| J | .015" |
Fig. 4c

ANTENNA ASSEMBLY FOR TELECOMMUNICATION DEVICES

BACKGROUND OF THE INVENTION

1. Field of Invention

This invention relates to antenna assemblies for handheld radio frequency transceivers, and more particularly to antenna assemblies for telecommunication devices such as cellular telephones, PCS devices, and the like.

2. Description of the Related Art

Various antennas have been proposed and implemented for radio frequency transceivers such as cellular phones, PCS telephones and the like. Antennas have also been proposed and developed for other applications, for example, U.S. Pat. No. 5,677,698 shows a slot antenna arrangement for portable personal computers.

Prior antennas for radio frequency transceivers for telecommunication devices such as cellular telephones and PCS devices have been significantly limited, however, by limited signal range, limited directionality, significant radio frequency radiation output to the user, significant multipath interference, and other related performance limitations.

Accordingly, it is the primary object of this invention to provide an improved antenna for communication devices including hand-held radio frequency transceivers such as cellular phones and PCS devices with improved directionality, broadband input impedance, increased signal strength, and increased battery life. The present invention reduces radio frequency radiation incident to the users body and reduces the physical size requirements for the directional antenna used on communications devices. Other benefits include a reduction in multipath interference, increased front-to-back ratio, improved peak gain while reducing radiation towards the user's upper body. The antenna assembly of the present invention may be integrated into the "flip" portion or the rear panel of a cellular transceiver, for example, and is accordingly less susceptible to bending or breakage during normal operations.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a multiple-element directive antenna for a hand-held radio frequency transceiver, such as a cellular telephone or PCS device is provided and has an active radiating conductor element, a dielectric spacing member, and a conductive ground plane element. The dielectric spacing member is communicatively linked to the active radiating conductor element and to the ground plane. The conductive ground plane member may be provided by a printed circuit board or other conductive surface of the hand-held radio frequency transceiver. The multiple-element directive antenna allows for improved directionality and reduced user exposure to radio frequency radiation.

The antenna assembly may be used in wireless communications device such as a cellular telephone or PCS devices where a low physical profile antenna is desired. The antennas of the present invention are particularly suited to receive and radiate electromagnetic energy in the 1850–1990 MHz band. The disclosed antenna is rugged, simple in design, low cost, low physical profile, and provides superior conformal capability with respect to the handset chassis of the wireless communication device. The thickness of the present antenna can be held to a minimum. Due to their relative size and conformability, such antenna is preferably housed within a pivoting or "flip" panel portion of the transceiver device, or on a back chassis surface of the device.

BRIEF DESCRIPTION OF THE DRAWINGS

The accompanying drawings, which are incorporated in and constitute a part of the specification, illustrate preferred embodiments of the invention and, together with a general description given above and the detailed description of the preferred embodiment given below, serve to explain the principles of the invention.

FIGS. 4*a* and 4*b* show plan and elevation views of such antenna, according to the invention.

FIG. 4*c* is a table showing preferred dimensions of such antenna and is designated Table 1, according to the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, an antenna assembly for a radio frequency transceiver such as a cellular or PCS communications device. The antenna assembly includes a radiating conductor element disposed upon a major surface of a dielectric substrate and spaced a distance away from a ground plane member. The ground plane member may be disposed upon a major surface of the dielectric substrate opposite the radiating conductor element, and may consist of the ground plane of the printed circuit board of the transceiver device or portion thereof, conductive portions of the device chassis or housing, the battery pack of the device or a separate conductive surface.

In one embodiment, the radiating conductor element of the present invention may overall be substantially planar in form and may be slightly concave along an axis. The radiating conductor element includes an elongate slot aperture within its boundary. The slot aperture may be substantially rectangular in form and extend in a direction which is substantially parallel to the radiating conductor element's axis of concavity. A coaxial feed line may extend generally perpendicularly to the axis of the slot or away from and parallel to the slot. Feed points of the antenna assembly are made at points along the slot aperture's periphery.

In another embodiment, the radiating conductor element with slot may be "C" or channel shaped an have a base panel portion and two downwardly bent leg members. The radiating conductor element is constructed of a conducting material and is positioned upon a top surface of a dielectric substrate member. The radiating conductor element, dielectric substrate member, and a ground plane member are positioned in generally overlapping or "laminated" relationship to each other. The spacing or relative position between the radiating conductor and the ground plane is an important parameter to the antenna assembly's electrical performance. The ground plane of this "laminated embodiment may be capacitively coupled to a conductive ground plane on or within the radio frequency transceiver device to obtain the desired performance benefits. Coupling to the inherent transceiver ground plane in this fashion allows the improvements in electrical performance to be achieved more independently of transceiver design.

Figure 1:
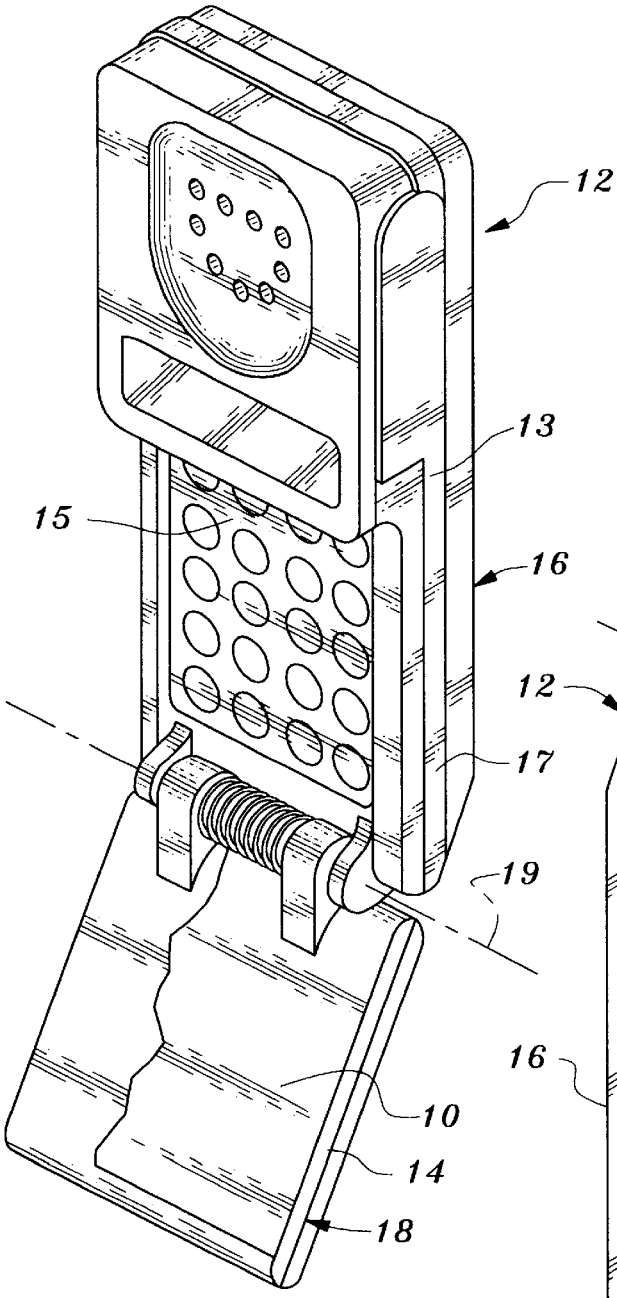
FIG. 1 is a perspective view of a telephone hand-set with the directional antenna of the present invention positioned in a lower hinged panel, according to the invention.
Figure 2:
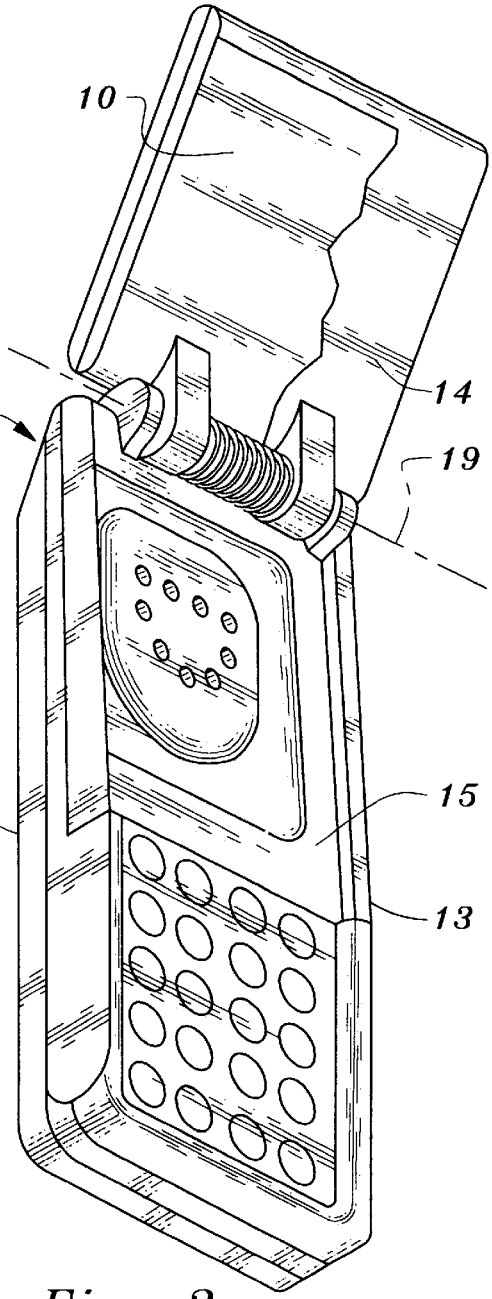
FIG. 2 is a perspective view of a telephone hand-set with the directional antenna of the present invention positioned in an upper hinged panel, according to the invention.

In FIGS. 1 and 2 the antenna assembly 10 for communication devices, is shown according to a preferred embodiment of the invention on hand held cellular telephone handsets 12. In FIG. 1 the antenna assembly is positioned on the outside of a lower hinged "flip" or panel portion. In FIG. 2, the antenna assembly is positioned on the outside portion of upper hinged "flip" or panel portion. The handset includes a main body portion 13 and a hinged "flip" or panel portion 14, which in FIGS. 1 and 2 is shown in its opened, operational position. Telephone handset 12 preferably includes a front side 15 having a speaker and microphone (not shown) and a rear side 16. The existing conducting ground plane 17 in handset 12 must be electrically connected to a conducting ground plane 18 located within the flip portion 14. This may be accomplished by a metal hinge 19 or the like. The antenna assembly 10 and the ground plane extension 18 are preferably concealed or encased in the plastic flip portion 14. Antenna assembly 10 is preferably formed by a planar or concave radiating conductor element generally separated from a larger ground plane by a dielectric material. The radiating conductor element has a slot with a low impedance coax. The dielectric material may be, for example, the case of a cellphone, and the ground plane may be the inherent ground plane in a cellphone.

Figure 3:
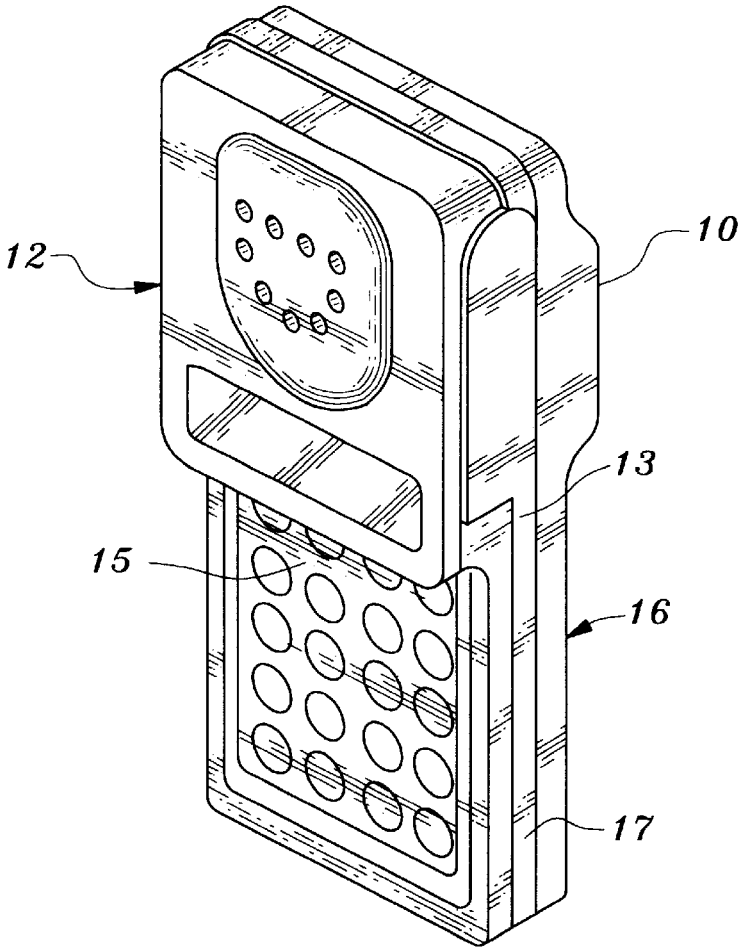
FIG. 3, illustrates a cellular handset with such antenna positioned on the rear top thereof, according to the invention.

With reference now to FIG. 3, cellular telephone handset 12 and antenna assembly 10 are shown with antenna assembly 10 concealed or encased in the housing of the transceiver. The antenna location shown is preferred so as to minimize the potential for contact by the user's hand. Antenna assembly 10 may also be used with other types of transceiver devices such as PCS devices, monitoring apparatuses, and the like.

Referring now to FIGS. 4*a* and 4*b*, antenna assembly 10 is shown in plan and elevation view with antenna assembly 10 having transmission side (a) and a shielded side (b). Placement of the antenna assembly 10 on the transceiver device 12 is such that during operation, the shielded side (b) is directed toward the device 12 user and the transmission side (a) is generally directed away from the user. Antenna assembly 10 preferably includes a radiating conductor element 20 with slot 21, preferably rectangularly configured, a dielectric substrate 22, and a conducting ground plane member 23. A low impedance coax feedline may be connected along the edges of slot 21 at points x and y. The shape and size of the radiating conductor 20, slot 21, location of feedline connection points x and y, and the spacing 24 to the ground plane 23 are critical to operation of antenna assembly 10. In FIG. 4*c* Table 1 lists dimensions and typical values for 1850–1190 MHz range. The dielectric 22 and ground plane 23 may extend beyond the edges of radiating conductor 20. The dielectric material may have a dielectric constant of one or greater. Antenna assembly elements 20, 22, and 23 may be positioned in a laminar fashion and glued or otherwise secured together.

Figure 5:
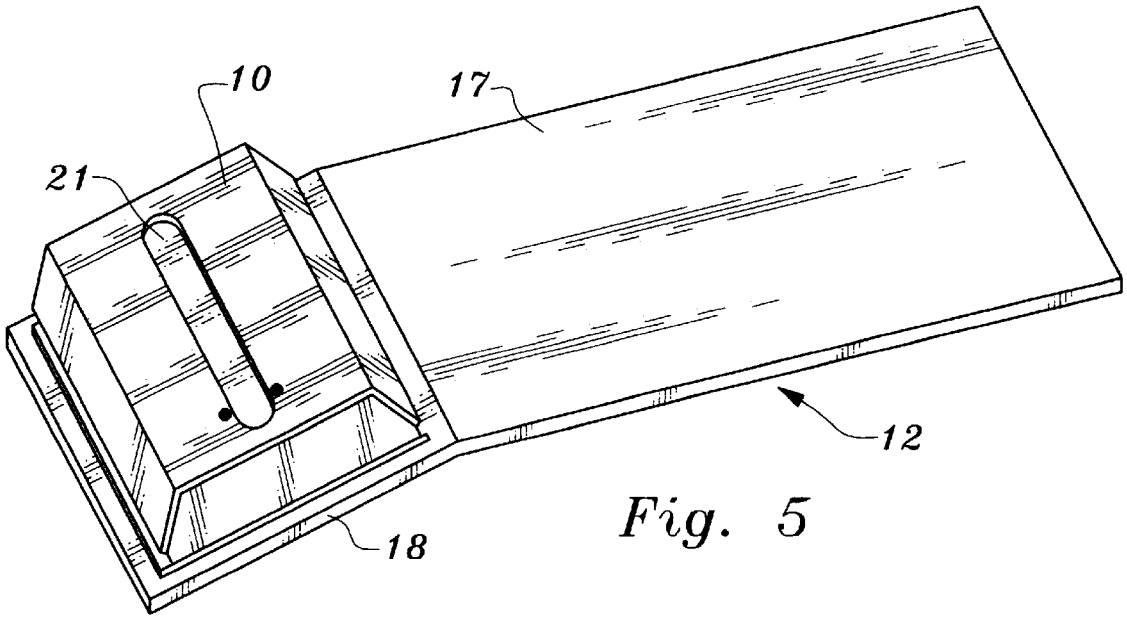
FIG. 5, shows the location of the antenna assembly with respect to the handset ground plane, according to the invention.

As seen in FIG. 5, antenna assembly 10 may be positioned on or above the ground plane 17 that exists within the transceiver 12 or the extension thereof 18 in flip portion 14. This is illustrated without the handset present. The separation of ground planes 17 and 23 is generally not critical, however, it provides sufficient capacitive or direct (dc) coupling over the frequency band(s) of interest, and may be filled with a dielectric material of relative dielectric constant one or greater. The polarization of the antenna assembly 10 is linear, and in a direction at 90 degrees to slot 21 and parallel to the plane containing slot 21.

Antenna assembly 10 may be formed as a C-shaped radiating conductor element critically spaced from a ground plane of a similar projected area by a dielectric spacer. Radiating conductor element 20 preferably has a slot fed with low impedance coax. The ground plane 23 is coupled directly or capacitively to a larger ground plane, the larger ground plane may, for example, be the inherent ground plane of a cellphone.

Figure 6:
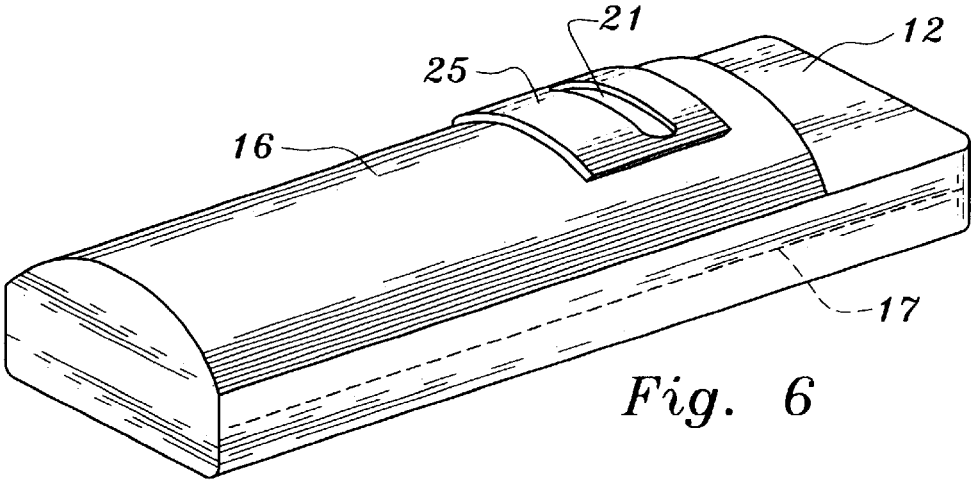
FIG. 6, shows the antenna of the present invention positioned on a rear portion of a cellular handset, according to the invention.
Figure 7A:
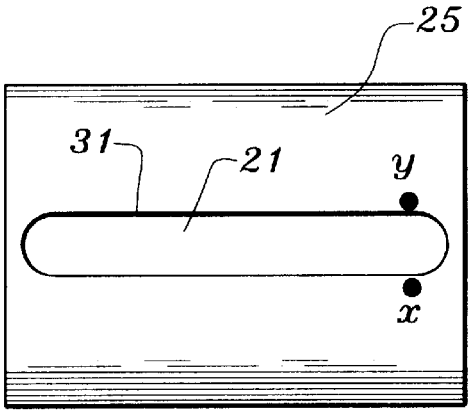
FIG. 7A and B show front and elevational views of the antenna of the present invention positioned on a rear portion of a cellular handset, according to the invention.
Figure 7B:
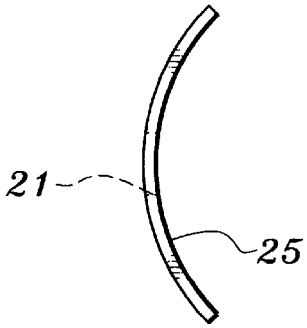

In FIG. 6, cellular telephone handset 12 and an antenna 25 are shown with antenna 25 mounted directly to the dielectric material on the rear 16 of handset 12, which may be a battery pack. The general location shown is preferred, so as to minimize potential contact with the user's hand. Antenna 25 may be incorporated into the plastic of the battery pack or that of the handset. In one embodiment of the invention, as seen in FIGS. 7*a* and 7*b*, antenna 25 comprises a radiating conductive element only. Previously discussed dimensions and design considerations discussed with reference to antenna assembly 10 apply to this embodiment of the antenna as well.

Figure 8A:
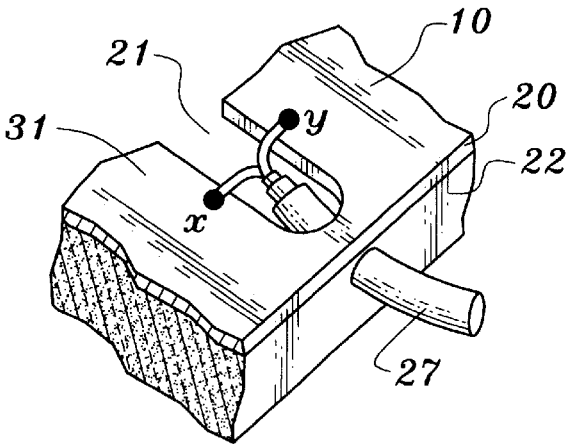
FIGS. 8*a* and 8*b* show preferred routings of a coax feedline from the radiating conductor element, according to the invention.
Figure 8B:
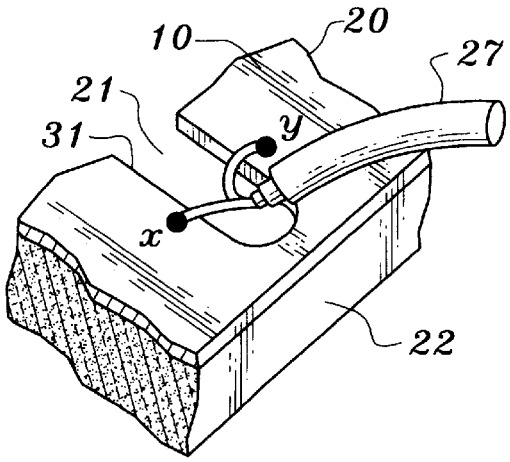

Referring now to FIGS. 8*a* and 8*b*, a preferred routing or location of coax feedline 27 from antenna assembly 10 or antenna 25 is shown. Preferably coax leads x and y are connected to periphery 31 of slot 21 by soldering. The inclusion of the cellphone's inherent ground plane, which is generally rectangular in shape, into the antenna assembly 10, results in increased gain over that expected from a conventional slot antenna.

In operation and use antenna assembly 10 is extremely efficient and effective. The antenna assembly of the present invention provides improved directivity, broadband input impedance, increased signal strength, and increased battery life. The antenna of the present invention reduces radio frequency radiation incident to the user's body, and reduces the physical size requirements of directional antenna used in cell phone handsets, PCS devices and the like. The disclosed antenna also increases front-to-back ratios, reduces multipath interference, and is easily integrated into the "flip" or rear panel portion of a cellular transceiver device, which minimizes the risk of bending and breaking.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An antenna assembly for a radio-frequency telecommunication transceiver, said transceiver having an electronic device, said antenna assembly comprising:

a conductive radiating element having a central portion and a pair of leg portions, said conductive radiating element having an elongate aperture thereon, said conductive radiating element operatively coupled to the transceiver electronic device, said pair of leg portions extending in a first direction away from the central portion;

a conductive ground plane member spaced a distance away from the conductive radiating element in the first direction, said pair of leg portions extending towards the conductive ground plane member, said conductive ground plane member operatively coupled to the transceiver electronic device; and a dielectric member, at least a portion of said dielectric member disposed between the conductive radiating element and the conductive ground plane member.

2. An antenna assembly for a radio-frequency telecommunication transceiver according to claim 11, wherein the central portion of the conductive radiating element is rectangular and substantially planar.

3. An antenna assembly for a radio-frequency telecommunication transceiver according to claim 2, wherein the central portion of the conductive radiating element is substantially parallel to the ground plane member.

4. An antenna assembly for a radio-frequency telecommunication transceiver according to claim 11, wherein the elongate aperture is disposed entirely on the central portion and aligned along a longitudinal axis of the conductive radiating element.

5. An antenna assembly for a radio-frequency telecommunication transceiver according to claim 4, wherein the leg portions are substantially aligned with the longitudinal axis.

6. An antenna assembly for a radio-frequency telecommunication transceiver according to claim 4, wherein the elongate aperture has a length dimension which is substantially equal to a length dimension of the conductive panel member in the direction of the longitudinal axis.

7. An antenna assembly for a radio-frequency telecommunication transceiver according to claim 1, wherein at least a portion of the dielectric member is in contact with the conductive radiating element.

8. An antenna assembly for a radio-frequency telecommunication transceiver according to claim 1, wherein the ground plane member is a conductive panel member separate from a ground plane of the electronic device.

9. An antenna assembly for a radio-frequency telecommunication transceiver according to claim 1, wherein the dielectric member has a dielectric constant of one or greater.

10. An antenna assembly for a radio-frequency telecommunication transceiver according to claim 1, wherein the transceiver further includes a case member, and wherein the dielectric member is a portion of said case member.

11. An antenna assembly for a radio-frequency telecommunication transceiver, said transceiver having an electronic device, said antenna assembly comprising:

a conductive radiating element having a central portion and a pair of leg portions, said conductive radiating element having an elongate aperture thereon between the pair of leg portions, said conductive radiating element operatively coupled to the transceiver electronic device, said pair of leg portions extending in a first direction away from the central portion;

a conductive ground plane member spaced a distance away from the conductive radiating element in the first direction, said pair of leg portions extending towards the conductive ground plane member, said conductive ground plane member operatively coupled to the transceiver electronic device; and a dielectric member, at least a portion of said dielectric member positioned between the conductive radiating element and the conductive ground plane member.

12. An antenna assembly for a radio-frequency telecommunication transceiver according to claim 11, wherein the central portion of the conductive radiating element is rectangular and substantially planar.

13. An antenna assembly for a radio-frequency telecommunication transceiver according to claim 11, wherein at least a portion of the dielectric member is in contact with the conductive radiating element.

14. An antenna assembly for a radio-frequency telecommunication transceiver according to claim 11, wherein the ground plane member is a conductive panel member separate from a ground plane of the electronic device.

15. An antenna assembly for a radio-frequency telecommunication transceiver according to claim 11, wherein the transceiver further includes a case member, and wherein the dielectric member is a portion of said case member.

16. An antenna assembly for a hand-held radio-frequency telecommunication transceiver, said transceiver having an electronic device, said antenna assembly comprising:

a concave conductive radiating element having an elongate aperture thereon, said concave conductive radiating element operatively coupled to the transceiver electronic device, said concave conductive radiating element having a direction of concavity;

a conductive ground plane member spaced a distance away from the concave conductive radiating element in the direction of concavity, said conductive ground plane member operatively coupled to the transceiver electronic device; and a dielectric member, said dielectric member spaced between the concave conductive radiating element and the conductive ground plane member.

17. An antenna assembly for a hand-held radio-frequency telecommunication transceiver according to claim 16, wherein at least a portion of the dielectric member is in contact with the concave conductive radiating element.

18. An antenna assembly for a hand-held radio-frequency telecommunication transceiver according to claim 16, wherein the concave conductive radiating element is rectangular.

19. An antenna assembly for a hand-held radio-frequency telecommunication transceiver according to claim 16, wherein the ground plane member is a conductive panel member separate from a ground plane of the electronic device.

20. An antenna assembly for a radio-frequency telecommunication transceiver according to claim 16, wherein the transceiver further includes a case member, and wherein the dielectric member is a portion of said case member.

* * * * *